United States Patent [19]

Hartup

[11] 4,138,000

[45] Feb. 6, 1979

[54] CHECKOUT COUNTER

[75] Inventor: Frederick W. Hartup, Sacramento, Calif.

[73] Assignee: Bel Air Mart, Sacramento, Calif.

[21] Appl. No.: 814,029

[22] Filed: Jul. 8, 1977

[51] Int. Cl.[2] ..... E04H 3/04

[52] U.S. Cl. ..... 186/1 A; D6/143; 186/1 AC

[58] Field of Search ..... D6/143; 186/1 A, 1 AC; 312/140.1

[56] References Cited

U.S. PATENT DOCUMENTS

| | | | |
|---|---|---|---|
| 2,884,094 | 4/1959 | Roy | 186/1 AC |
| 2,980,211 | 4/1961 | Richter | 186/1 A |
| 3,437,177 | 4/1969 | Close | 186/1 A |
| 3,473,484 | 10/1969 | Close | 186/1 AC X |
| 3,819,012 | 6/1974 | Beck, Jr. et al. | 186/1 A |
| 3,990,540 | 11/1976 | Aleshire et al. | 186/1 AC |
| 4,043,426 | 8/1977 | Verkler | 186/1 A X |

FOREIGN PATENT DOCUMENTS

| | | | |
|---|---|---|---|
| 312062 | 6/1969 | Sweden | 186/1 A |

*Primary Examiner*—Stephen G. Kunin

*Attorney, Agent, or Firm*—Reed C. Lawlor

[57] ABSTRACT

An elongate checkout counter having a flat counter top, front and rear sides, a left or upstream end and a right or downstream end is provided that is particularly adapted for use in combination with a counter related UPI System scanner, a cash register and a produce scale. The left or upstream end is disposed to facilitate positioning a shopping cart in convenient left-hand reach of a checker stationed at the front side of the counter. A flat scanner panel is positioned in the top adajcent the upstream end, in convenient left-hand reach of the checker. A cash register with a forwardly disposed manually operable keyboard is positioned on the counter top adjacent said upstream end and rear side rearward of the scanner panel. A produce scale with a tray is positioned on the counter top downstream of the cash register and the scanner panel to project forwardly beyond the forward limits of the cash register and an elongate conveyor in the counter top with an upstream end between the tray and said front side. The cash register, produce scale and conveyor are within convenient reach of the right arm and hand of the checker when the checker transfers items from a shopping cart to the scanner panel with his left hand.

24 Claims, 7 Drawing Figures

CHECKOUT COUNTER

CROSS-REFERENCES TO RELATED APPLICATIONS

Design Patent application Ser. No. 772,769, filed Feb. 28, 1977, now abandoned.

INTRODUCTION

This invention has to do with an improved checkout counter and is particularly concerned with an improved checkout counter for use in combination with and utilization of a Uniform Price Code System.

In the art of merchandising, particularly in supermarkets and in discount stores, it has become customary to mark each item in markets or stores with its selling price; displaying the items in the stores, providing wheeled basket type shopping carts for the customers and into which they can deposit selected items; and the provision of checkout counters, manned by cashiers, to which the shopping carts are advanced and at which the sale of selected goods is consummated.

The above noted system and means for shopping is well known and familiar to an overwhelming majority of persons throughout the country and is such that many specific details involved therein need not and will not be treated specifically herein.

The end or ends to be attained in the class or sort of merchandising system noted above is convenience to the shopper and efficiency in the operation of the stores or markets. The operating efficiencies sought to be attained are: minimum required operating personnel in the stores; accuracy in charging for customer-selected items; and speed in completing the sale of customer-selected items or purchases.

While the checkout counter art is old and has become highly developed over the years, it has, until recently, been wanting in certain respects.

One serious problem or shortcoming in the art resides in the fact that in the course of marking the prices on the multitude of items in stores, errors are frequently made. Another problem resides in the fact that prices often change and many man-hours must be expended remarking items. Yet another problem resides in the fact that many items are not marked or the marks applied thereto are so smudged and unclear that they cannot be read, thus requiring the expenditure of valuable time and effort to ascertain the price of such items before a sale thereof, at a checkout counter, can be effected. Still another matter not handled or eased by common checkout counter systems of the prior art resides in the lack of means to identify and record items sold and to correlate such data with a store's inventory.

In the recent past, a new type or class of system for identifying and pricing products or items, recording sales of such items and correlating such sales with stores' inventories has been developed. Ongoing or continuing efforts are being made to put such a system into effective and efficient use. The new system referred to above is called "UNIVERSAL PRODUCT CODE SYSTEM" and is commonly referred to as the UPI System. The UPI System includes the printing of an identifying symbol, comprising a series of bars and numbers, on each item to be marketed. The symbols are printed on items by the manufacturers or distributors of the items. The UPI System next includes a central computer in which all pertinent data concerning a store's inventory is stored, including the identifying symbols, stock on hand, and current prices of all items. The computer is programmed to transmit, upon command, a signal corresponding to the price and other pertinent data of each coded item and to appropriately adjust or correct the store's inventory record upon the sale of any coded item. The UPI System next includes an electronic optical reading device or scanner at each checkout counter of a store which reads the symbols printed on items and which is operatively related to the computer and, oftentimes, to a cash register at the counter. In operation, in effecting the sale of coded items, the items are moved past the scanner, the scanner reads the symbols thereon and transmits operating signals corresponding to the symbols, to the computer. The computer correlates the signals from the scanner with stored data and in accordance with its program, functions to correct inventory records and signals the cash register, to display and register the current price and other desired data regarding the items. In some instances, the cast register automatically registers the prices while in other cases, simply displays the prices, enabling the checker to manually operate the cash register to ring up or register the prices.

The adoption and use of the UPI System in checkout counters requires the inclusion of the aforementioned symbol reading scanner in or at the counter and requires the provision of a special cash register with which the central computer and/or the scanner can be suitably operatively related. The cash register, in addition to a conventional manually operable keyboard, is provided with or includes electronic operating means to effect its operation in response to signals from the computer. The manual means is required to register and effect the sale of uncoded items not included in the UPI System.

While the inclusion of a UPI System scanner in a conventional checkout would appear to be a simple, uncomplicated addition, it has proved to present a number of major problems for the checkers working such counters and has resulted in a number of fundamental changes in checkout counters, designed and/or intended to make the adoption of the UPI System practical, effective and efficient.

The first requirement to be considered in adoption and use of the UPI System is that items marked with the identifying system symbols must be manually oriented relative to and moved by the scanner, one at a time. This requirement eliminates the old and common practice of customer participation wherein customers emptied their shopping carts at a checkout counter and the items were allowed or caused to accumulate and crowd together on the counter in close proximity to the checker for their manual manipulation.

It is now accepted that, for most effective and efficient use of the UPI System, the checkers must manually transfer items from shopping carts to the checkout counters, one at a time, and in doing so, orient and move the items relative to the scanners. This requirement eliminates customer participation as noted above and requires that the counters provide for positioning the shopping carts, scanners, cash registers and, oftentimes, produce weighing scales, in close proximity to stations adjacent the counters where the checkers are located or stand, whereby each of the noted components and/or means are in easy, effective and comfortable reach of the checkers.

The above has led the art to provide new elongate checkout counters with upstream or receiving ends adjacent which shopping carts can be suitably parked or positioned for free access to items deposited therein by the checkers. These new counters, as a rule, are first provided with UPI System scanners at their top surface, adjacent said upstream ends, whereby checkers transferring items from carts to the counters can orient and advance the items relative to and past the scanners, one at a time, in substantially continuous and uniform movements; UPI System cash registers downstream of the scanners and produce weighing scales downstream of the cash registers. The checkers are stationed at sides of the counters adjacent said upstream ends thereof and within arm's reach of the carts, scanners, cash registers and scales. The scanners at the upstream end of the noted series of components or devices are commonly arranged adjacent the front side of the counters and the cash registers and produce scales are arranged adjacent the rear side of the counters. This arrangement permits free downstream movement of items on the counters, from the scanners by and in front of the cash registers and produce scales.

In addition to the above, checkout counters of the character referred to above have been set up or arranged so that the checker's right arms and hands are utilized to manually engage and transfer items from related shopping carts to the counters and so that their left arms and hands are utilized to operate the cash registers and produce scales. This setup or arrangement appears to have been adopted with the idea or understanding that the average checker is right-handed and possesses greater dexterity and strength in his right arm and hand than in his left arm and hand, which greater dexterity and strength is best put to use in the job or task of transferring items from shopping carts to the counter tops.

While the above noted new checkout counters are operable or serviceable, they have afforded less effectiveness and efficiency than is desired or demanded by those who must work them.

The first and most notable deficiency in the above noted basic form of new, UPI System checkout counter, resides in the fact that while related shopping carts, scanners, registers and scales are within arms reach of the checkers, they require the checkers to over-extend their reach and /or move their arms and bodies excessively in the normal course of checking out the sales of customer selected items, which extension and movement results in premature fatigue.

The prior art has sought to overcome the above noted problem by establishing L-shaped counters and arrange the several noted components, in series, about the corners established by such counters whereby more accessible or convenient positioning of the components, relative to the checkers, is sought to be attained.

While such structures afford limited benefits, they are not new problems and have proved to be less than satisfactory or sufficient.

As a result of the foregoing, a checkout counter for use with or incorporating a UPI System which is sufficiently easy, effective and efficient to work or operate to meet all the demands of checkers who must work with them, as well as the demands of those who employ and/or oversee the work of such checkers, has not been provided by the prior art.

It has been observed that checkers working at checkout counters of the character referred to above tend to transfer items from related carts to the scanners at the counter tops with their right hands, release the items and register the sale of the items on the cash register with their right hands. Proceeding, they re-engage the items and advance them downstream on the counter with their right hands. This procedure is repeated with each item handled. A strong tendency for checkers working at such counters to refuse or fail to use their less skillful and less preferred left hands, oftentimes called their "off hands," has been noted. Such refusal or failure to use their left or off hands becomes more apparent as the checkers tire or fatigue. The foregoing is apparently due to the fact that operating a cash register and/or produce scale with one's off hand is not normal or comfortable and is instinctively rejected.

Another factor which comes into play in the above noted procedure is the fact that the transferring of items from shopping carts to related checkout counters, as noted above, is semi-stoop labor and is such that the checkers' bodies are unnaturally disposed with respect to the cash registers and produce scales and such that operation of the cash registers and produce scales with their off, or left, arms and hands is made more difficult and tiresome. In those instances where a checker uses his off, or left, hand to operate the cash register at a counter while transferring items from a related shopping cart to the counter with his right hand, it has been observed that the checker tends to torque his body in a most unnatural and fatiguing manner, in order to gain better or more natural body positioning relative to the cash register and/or scale.

PHYSIOLOGICAL CONSIDERATIONS

It has been determined that the normally weaker and less dexterous left, or off, hand and arm of the average checker is sufficiently dexterous and strong to easily, effectively and efficiently transfer items, one at a time, from a shopping cart to a checkout counter and to orient those items relative to a scanner on the checkout counter; if the body of the checker is effectively arranged and disposed with respect to the shopping cart and counter and the arm movement which is required is an efficient and effective movement. It has also been determined that when checkers are caused to use their off, or left, hands to transfer items from carts to counter, they instinctively use their right hands, coincidentally therewith, to operate the cash registers and/or the produce scales. Such two-handed operation materially speeds up the process of checking out items, especially when using a UPI System, and also increases the overall efficiency of the checkout process or operation to be effected.

It has been observed that when checkers assume a semi-stooped position to effect the transfer of items, one at a time, from shopping carts to checkout counters, with one hand and seek to operate cash registers and produce scales on the counter with their other hand, they tend to torque their bodies excessively and in an unnatural manner when their left hands are employed to operate the cash register and produce scales. However, they torque and move their bodies to a materially less extent when their right hands are used or employed to operate the cash register and scales. This is apparently due to the fact that off, or left, hand operation of such devices, being unnatural, requires the checkers to forcibly orient their bodies relative to such devices to effect efficient operation thereof, whereas right hand operation of such devices is easy, and can be effectively executed with little if any forcing.

In addition to the foregoing, it has been determined that more convenient and effective manual access to the several noted checker operated devices on a checkout counter can be gained by departing from the common linear, series arrangement of the devices and that by appropriate non-aligned series arrangement of the devices, more convenient and materially less fatiguing access thereto is possible.

OBJECTS AND FEATURES

In accordance with the foregoing, it is an object and feature of this invention to provide a new checkout counter for use in connection with or the incorporation of a UPI System which is such that a checker working the counters is required to transfer items from a related shopping cart to the counter top and to orient the items relative to a scanner at the counter top with his off, or left, arm and hand. A counter which is such that a related cash register and produce scale are disposed and arranged relative to the checker, counter top, cart and scanner, whereby the checker can easily and effectively operate the cash register and produce scale in a comfortable and non-fatiguing manner, with his right arm and hand, coincidentally with the transferring of items from the cart to the counter with his left hand.

It is an object and feature of the present invention to provide an elongate checkout counter with an upstream receiving end, a downstream discharge end and with front and rear sides, which counter is arranged in spaced, substantially parallel relationship between a pair of elongate, laterally spaced barriers whereby said front side and its adjacent barrier define a checker and cart transfer aisle and said rear side and its related barrier define a customer aisle; said checker aisle occurring at the right side of the counter and the customer aisle occurring at the left side of the counter looking downstream of the counter.

It is an object and feature of the invention to provide a checkout counter of the character referred to above wherein the upstream, receiver end thereof is flat and is disposed so that an upwardly open wheeled shopping cart can be parked in close proximity therewith for free access to items deposited therein, for removal by the off, or left, hand of a checker stationed in the upstream end of the checker aisle and facing substantially rearwardly and so that a cash register and produce scale atop the rear upstream end portion of the counter are visible and within easy, convenient and non-fatiguing reach of the checkers for right hand operation and use thereof.

Still another object and feature of the present invention is to provide an improved checkout counter of the general character referred to wherein the scanner, cash register and produce scale are at the upstream end of the counter and are arranged both longitudinally and laterally of the counter top, whereby portions of the scanner, cash register and produce scale occur in staggered, overlapping relationship with each other, laterally and longitudinally of the counter top whereby the scanner and a shopping cart at the upstream end of the counter are in close, convenient proximity for left-hand reach and the cash register and scale are in close, convenient proximity for right-hand reach of a checker stationed at the front side of the counter adjacent said upstream end thereof.

It is an object and feature of the present invention to provide a checkout counter of the character referred to above, wherein the cash register has front, rear, upstream and downstream sides and is positioned at the upstream end of the counter adjacent the rear side thereof with its front side and a keyboard thereon, disposed counterclockwise relative to the longitudinal axis of the counter; said scanner is at the upstream end of the counter forward of the front side of the cash register; said produce scale is adjacent the downstream side of the cash register and is arranged to extend from the rear side toward the front side of the counter on an axis normally angularly related to the cash register whereby the forward upstream portion of the scale occurs forward of the cash register and downstream of the scanner.

Finally, it is an object and feature of this invention to provide a checkout counter of the character referred to above which includes an elongate, longitudinally extending conveyor with an upstream end portion arranged forward of the produce scale and a downstream end portion extending into the downstream end portion of the counter and adapted to move items longitudinally downstream of the counter top.

The foregoing and other objects and features of this invention will be fully understood and will be apparent from the following detailed description of the invention, throughout which description reference is made to the accompanying drawings.

DESCRIPTION OF THE DRAWINGS

FIG. 7 is a diagrammatic plan view of another embodiment of the invention.

DESCRIPTION OF THE INVENTION

Figure 1:
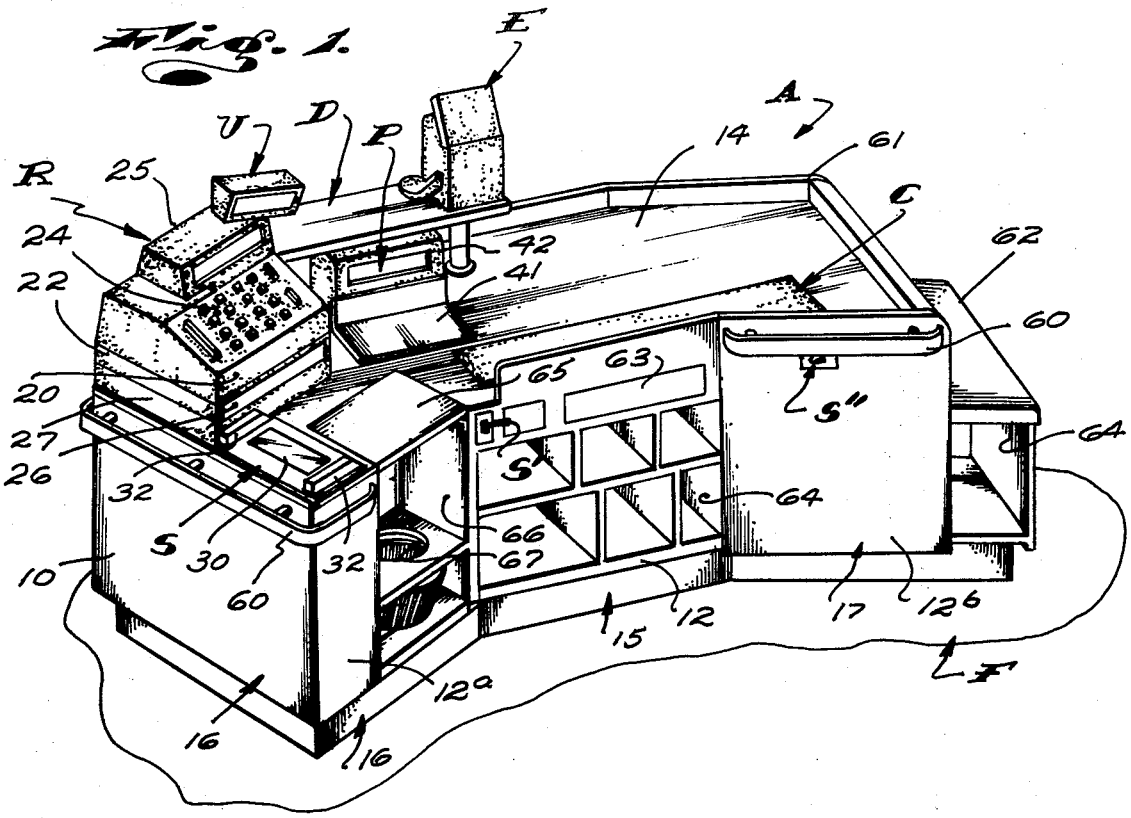
FIG. 1 is a perspective view showing the front side, top surface and upstream end of a checkout counter embodying the present invention.
Figure 2:
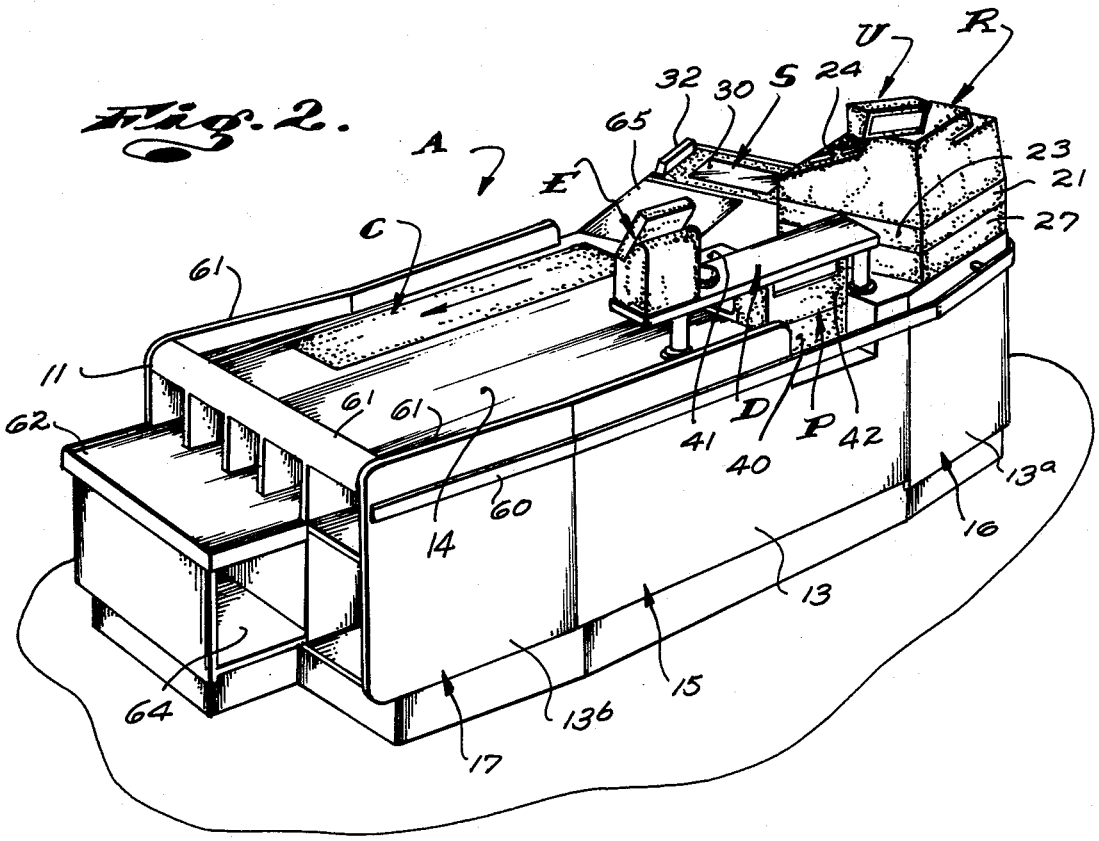
FIG. 2 is a perspective view showing the rear side, top surface and downstream end of the checkout counter.

Referring to the drawings, the new checkout counter A here provided is an elongate, unitary structure with a flat, vertical upstream or receiver end 10, a flat, vertical downstream or discharge end 11, a vertical longitudinally extending rear side 13 and a substantially flat, horizontal counter top or surface 14.

The counter A is a fabricated cabinet-like structure made in accordance with any suitable standards and specifications with respect to quality, materials and structural details which have been established and are commonly acceptable in the art and/or which might be specified or required.

Most details of construction and the materials used to establish the counter A in no way alter or affect the novelty and spirit of the present invention. Accordingly, to simplify this disclosure, only those details and/or features of the counter structure which materially affect the invention will be noted or considered below.

The cabinet A is characterized by a straight, longitudinally extending central body or intermediate portion 15 and angularly related upstream and downstream wing-like end portions 16 and 17. The wing-like end portions 16 and 17 are inclined forwardly at angles of approximately 15° relative to the central body portion and mean longitudinal axis Z—Z (see FIG. 3) of the counter, as they extend or continue longitudinally outwardly therefrom, whereby the counter can be said to have a winged plan configuration. The front side 12 of the counter has flat, vertical, laterally forwardly and longitudinally inwardly disposed, or longitudinally outwardly and laterally forwardly inclined, upstream and downstream end portions $12^a$ and $12^b$ respectively. And the rear side 13 of the counter has flat, vertical, laterally forwardly and longitudinally outwardly disposed, or longitudinally outwardly and laterally forwardly inclined, upstream and downstream end portions $13^a$ and $13^b$ respectively. The end walls 10 and 11, which are flat and substantially vertical, extend transversely of the longitudinal axis Z—Z. The two walls are inclined forwardly, converging to a point on the front side of the structure.

In practice, angular disposition of the downstream wing or end portion 17 of the counter A, while preferred and affording certain advantages, is optional. For example, should the end portion 17 be straight and aligned with the central portion 15, the broader aspects and main advantages of the present invention would still be attained.

Further, as diagrammatically shown in FIG. 7 of the drawings, the upstream end portion 16' of the counter A' can be straight or non-angularly related to the remainder of the counter and can have the various components and devices arranged thereon or related thereto, in accordance with certain novel features and without departing from the broader aspects of the present invention.

In the preceding and in the following the terms "upstream" and "downstream" make reference or relate to the normal direction of flow of items worked upon and moved or transported longitudinally of the counter when the counter is in normal use. Accordingly, items deposited on the top surface 14 at the receiver end 10 and moved to the discharge end 11 move downstream. Further, in accordance with the above, the receiver and discharge ends of the counter are preferably defined as upstream and downstream ends and any and all of those elements, components and/or devices which are a part of or relate to this invention, when oriented relative to the central longitudinal axis of the counter, can and will be described as having the upstream, downstream, front and rear sides whenever appropriate.

It is to be further noted at this time that the upstream and downstream ends of the counter occur at the left and right hand sides of a checker adjacent the front side of the counter and faced rearwardly relative thereto. In accordance with the preceding, the terms "upstream" and "downstream" can be considered synonymous with the terms "left" and "right" whenever appropriate, in the illustrated embodiments of the invention.

The rear upstream corner portion of the upstream portion of the top surface 14 is provided to accommodate and support a cash register R. The cash register, hereinafter sometimes called the "register" is a box-like structure, substantially rectangular in plan configuration and has substantially straight, front and rear sides 20 and 21 and straight, upstream and downstream sides 22 and 23. The register R, in accordance with common practice, has a manually operable keyboard 24 at or across the upper forward portion of the front side of the register. The keyboard 24 is forwardly and upwardly disposed, for convenient viewing and manual operation by a checker positioned forward of the counter and is disposed substantially rearwardly toward said counter and the register.

In accordance with common practice, the register R can be provided with price display means 25 for visually displaying the prices of items registered therein, taxes, the totals of purchases and the like.

In addition to the foregoing, the register R can be or is provided with or includes electronic operating means (not shown) which operate to register prices in response to signals received from a related UPI System computer (not shown) which might be arranged in some suitable location remote from the counter and which is suitably electrically connected therewith.

The above noted computer and operating means in the register are elements, components or parts of the UPI System which is incorporated in the counter or with which the counter is related.

U.S. Pat. No. 3,819,012, issued June 25, 1974, discloses a UPI System of the character concerned herewith. Since issuance of the above patent, many advances have been made and a number of systems of advanced designs are now produced by manufacturers such as NCR Corporation of Dayton, Ohio. The different systems vary considerably in functional capabilities and in physical make-up, but each is such that those components and means which are to be directly incorporated in checkout counters and counter related equipment can be effectively related thereto.

Generally, producers of UPI Systems and the like do not make checkout counters, but sell their equipment to the manufacturers of counters who simply install system computers for subsequent use. Accordingly, those in the art of manufacturing checkout counters of the type or class with which this invention relates are not and normally need not be knowledgeable about the technical aspects of UPI Systems. It is sufficient that when adopting and putting such systems to use, they select necessary and proper components and effectively connect and arrange or dispose the selected components for their effective use in the checkout counters produced. Accordingly, no detailed disclosure will be made or given with respect to any specific UPI System, and reference with respect thereto will be limited to specifying that those means, components and/or devices, which are a part of such a system and are included or embodied directly in the counter A, are UPI means, components, or devices.

In furtherance of the above, the register R, when provided with the above referred to UPI System operating means can be qualified and described as a UPI System cash register.

In practice, and in accordance with common practice, the register R can be and is preferably provided with printout means (not shown) for printing a permanent record of sales on paper receipt slips for customers and is provided with a cash drawer 26 in its front side, below the keyboard 24. The drawer 26 is such that when desired, the drawer moves and projects freely forwardly from the front side of the register to afford the checker free access to the interior thereof.

The surface 14 of the counter is spaced vertically above a deck or floor F on which the counter is mounted so that it is on a substantially common plane with or in convenient close proximity to the plane of the open top of the basket portion of a standard, conventional, wheeled, basket-type shopping cart W. While the vertical extent or height of the counter top is subject to being changed to best accommodate specific shopping carts, or vice-versa, for the purpose of this disclosure and for the purpose of example, it can be said that the counter top is 32" above floor level and that the top of the cart W is also 32" above the floor level.

Since conventional shopping carts of the character referred referred to are standardized and are well known to those skilled in the art, detailed illustrations and description thereof will be dispensed with.

The register R, depending upon its design and vertical placement of the cash drawer 26 and the keyboard 24, is mounted directly on the top surface 14, or on a vertically upwardly projecting platform on the surface 14, as shown at 27 in the drawings, or can be mounted within a register receiving well entering the surface 14, whereby the drawer 26 can shift freely forwardly therefrom and will occur in free working clearance above the portion of the surface 14 forward of the register and above parts and portions of a UPI scanner in that portion of the counter top as will hereinafter be described. Further, the register is positioned vertically above the surface 14 where its keyboard 24 is within clear view and within convenient right hand reach of a checker stationed adjacent the upstream portion 12$^a$ of the front side of the counter and facing the register.

The counter A next includes a UPI System optical reader unit or scanner S, which is adapted to read identifying codes or symbols printed on items to be handled and sold. The scanner S is mounted within the upstream end portion 16 of the counter, beneath the surface 14, and includes a flat, horizontally disposed, top plate with an item supporting and orienting glass pane or panel 30 and arranged in an opening 31 in the top of the counter, with its top surface substantially coplanar with the surface 14.

In addition to the above, the means S can include a pair of laterally spaced, parallel, longitudinally extending guide rails 32 on the top plate at opposite sides of the panel 30. Such guide rails are required in certain UPI Systems and include photoelectric triggering means to automatically set the scanner into operation when coded items, the codes of which are to be read, are positioned on the panel 30. The scanner S is cooperatively related to and/or connected with a register R and/or with the above noted UPI computer, as is required in the UPI System of which it is a part. It is to be noted that the cash drawer 26 of the register R is spaced above and overlies the panel 30 and the rail 32 adjacent the register when the drawer is shifted forwardly to its noted open position.

It is highly important to note that the flat, vertical receiver or upstream end 10 of the counter A is immediately adjacent the upstream side 22 of the register R; is adjacent the upstream side of the scanner S; and is at the front left-hand quarter of a checker positioned or standing at and facing rearwardly toward the upstream end portion 12$^a$ of the front side of the counter.

Figure 3:
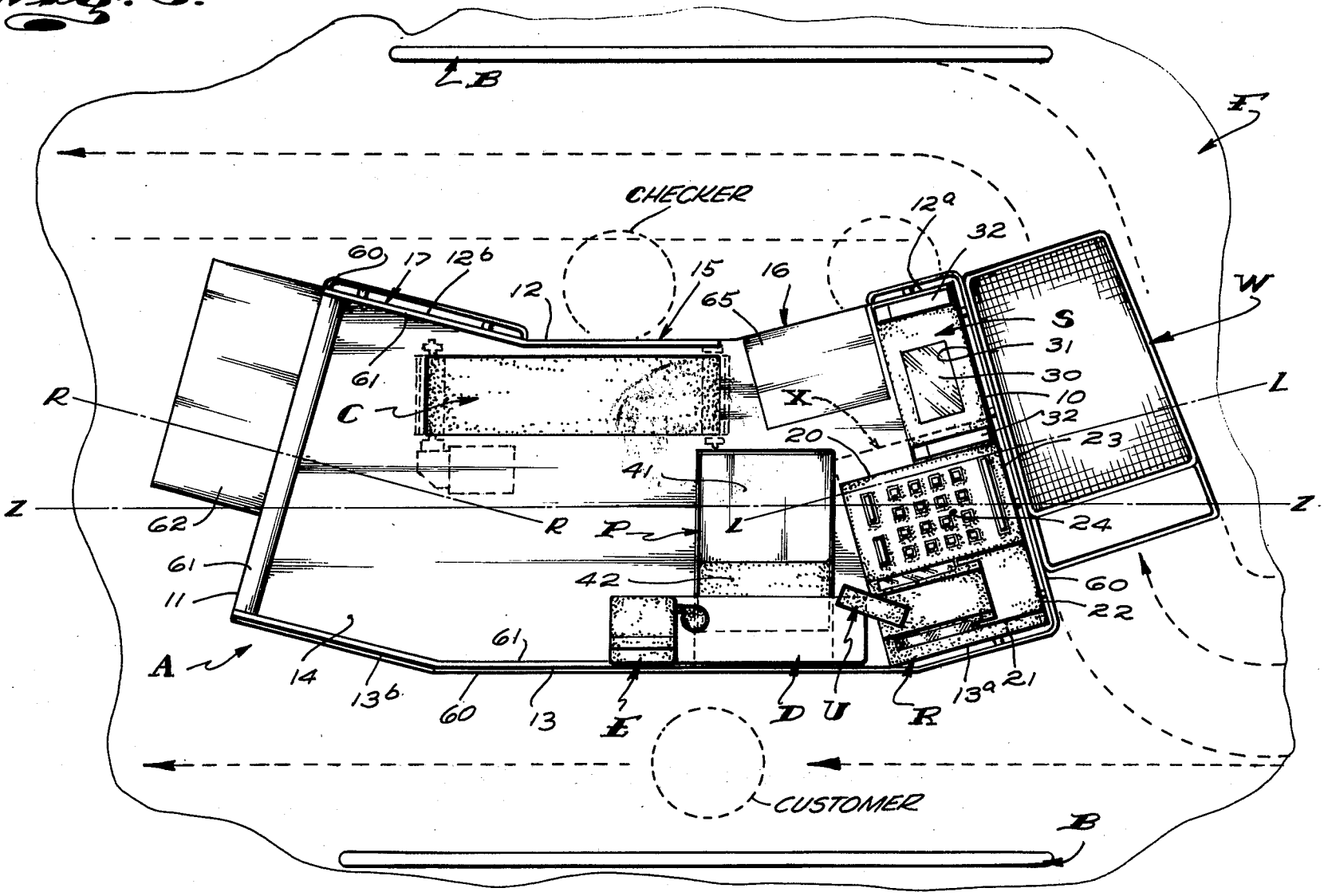
FIG. 3 is a top plan view of the checkout counter.

It is equally significant and important to note that the keyboard 24 of the register R is within easy and convenient reach of the checker's right hand, when his right arm is in a non-fully extended condition. Further, the cash drawer 26, when moved forward to its open position above the scanner S is freely accessible to either hand of the checker. Still further, the keyboard and cash drawer of the register are in convenient visual disposition and range to the checker. Of equal significance, the end 10 of the counter A is disposed and arranged with respect to the scanner S an register R whereby a shopping cart W can be effectively positioned in close proximity thereto (as shown in FIG. 3 of the drawings) whereby the interior of the basket portion of the cart and items that have been deposited therein are readily and conveniently accessible to the left hand of the checker when the checker is positioned and disposed relative to the counter, as noted above.

During operation or use of the counter A, when a checker must stoop forwardly downwardly and to the left to reach downwardly into the basket of a related cart, with his left arm and hand, to engage or pick up items in the lower portion thereof, his body naturally tends to torque so as to turn his head toward the register R for convenient viewing thereof. Such torquing of the checker's body also turns or swings his right shoulder upwardly and rearwardly toward the counter in a manner which tends to elevate and project his right arm and hand toward the register for convenient right hand contact with and operation of the keyboard 24. The extent or degree to which the checker must stoop and reach with his left hand, as noted above, is minimal and the extent to which his body is torqued is also minimal, whereby it is possible for the checker to retain such a position for a sufficient period of time to empty the contents of a shopping cart with his left hand and to operate the register with his right hand without undue fatigue.

The extent to which the checker must stoop, reach and torque his body toward and relative to the cart and to the counter top to remove the contents of the cart, one item at a time, is not sufficient to cause his torso to block, prevent or inhibit the free transporting of the items from the cart onto the panel 30 of the scanner S, while sustaining that position.

Additionally, the panel 30 of the scanner normally occurs substantially immediately in front of and is slightly below the checker's mid-section or torso when the checker is in the process of transferring items from the related cart to the counter and the upper portion of his torso or chest is normally disposed forwardly and downwardly toward the cart and the portion of the surface 14 immediately adjacent thereto whereby the movement and flexing of his left arm necessary to effect lifting items upwardly, out of the cart and downstream, onto the panel 30, is upwardly and inwardly toward his upper torso. Such movement and flexure of a person's off or left arm is normally the strongest and most controlled movement of that arm.

Otherwise stated, in transferring items from a cart to the counter top, with his left arm and hand, the checker need not extend his left arm laterally and/or horizontally to any appreciable extent to effect such transfer. The principal arm movement is the flexing and drawing of the left arm upwardly and inwardly toward the body.

As a result of the above, and by virtue of the relationship of parts herein provided, effective and efficient use of a checker's off, normally weaker and less dexterous left arm and hand, is made possible and practical.

it is important to note that the above operation is dependent upon and made possible by the fact that the scanner S is arranged in the top surface 14 of the cabinet adjacent or in close proximity to the upstream end of the counter adjacent which a related shopping cart can be positioned and is positioned forward of the forward upstream quarter of the register R.

In accordance with the preferred carrying out of this invention, the cash register support means or platform 27 is sufficiently high so that the cash register R can be shifted or slid forwardly so that its forward portion projects forwardly from the platform in spaced relationship above the surface 14 and above the rail 32 of the scanner adjacent the platform. In FIG. 3 of the drawings, the dotted line identified by the reference character X indicates the approximate maximum extent to which the register R can be shifted forwardly without undue interference with the scanner. With the above structure, it is possible, when necessary or desired, to reduce the distance between the register R and checker several inches without adverse effects. Such adjustment can be of critical importance for checkers of small physical stature.

It has been determined that if the register R was to be positioned downstream of the means S, a checker would be required to extend the reach of his right hand to a notably greater extent to maintain contact with the register. Any increase in extension of the checker's arms is undesirable, as it has profound effects on the physical stamina of a checker and results in early fatigue.

Such excess extension of the right arm would result in further and excess stooping and torquing of the checker's body, to effect the transfer of items from a related cart to the counter top. Such factors are cumulative in effect and result in impeding the transfer of items from the cart to the counter and orienting items relative to the scanner S. Viewing of the register R and items on the counter is made more difficult. Most important, such excesses in body positioning results in early fatiguing of the checker.

In addition to the foregoing, the counter A includes a weighing scale P for weighing produce or other products. The scale P includes a rectangular box-like base 40 with front rear upstream and downstream sides, a flat horizontal upwardly disposed produce supporting platter or tray 41 with like sides supported by and overlying the forward portion of the base and a housing 42 with forwardly and rearwardly disposed scale viewing windows projecting upwardly from the rear portion of the base to occur rearward of and above said tray. The scale P is arranged and supported in an upwardly opening scale receiving well 43 in the top of the counter, at the upstream end of the central portion 15 thereof and extending forwardly from the rear side toward the front side thereof.

The scale is positioned vertically in the well 43 and relative to the surface 14 so that the tray 41 is in a plane slightly above, but essentially common with the plane of the surface 14, whereby produce advanced downstream on the surface 14 toward the tray will freely advance on or into supported engagement on the tray.

The scale is further positioned so that the forward portion of the tray projects forwardly from and beyond the plane on which the front side 20 of the register R occurs.

The front to rear, or fore to aft, axes of the register R and scale P and the planes on which the opposing downstream side of the register R and upstream side of the scale tray 21 occur are angularly related and converge forwardly, whereby the downstream side of the register R converges toward the upstream side of the tray at a point spaced rearward of the front of the tray. With this relationship of parts, the forward upstream corner portion of the tray lies forward of the forward downstream corner of the register R, and the forward downstream corner of the register lies rearward of the forward upstream corner portion of the tray, substantially as shown in the drawings.

With such a relationship of parts, the major forward upstream portion of the tray is positioned within substantially the same arc of reach of the cashier's right arm and hand as is the keyboard 24 of the register R. Accordingly, when necessary, the cashier, positioned before the upstream end portion of the counter, as noted above, can, with his right hand, engage produce deposited on the upstream end of the counter top with his left hand, advance that produce downstream of the counter and onto the tray 41 of the scale, with great ease and efficiency and without having to change or alter the position of his body to any notable or material extent. Having thus deposited the produce on the scale, the checker can, with little effort, swing his or her arm back toward the keyboard 24 and register the price of the produce weighed.

It is important to note that the register R and the scale P are angularly related so that the forward portion of the tray 41 of the scale projects forwardly across the surface 14 a greater distance than does the register R, whereby free and unobstructed access to the tray 41 from the upstream side thereof is afforded. The forward portion of the tray projecting into the upstream portion of the surface 14 is in close and most convenient proximity to the right arm and hand of a checker positioned at the front side of that portion of the top surface.

The counter A here provided next includes conveyor means C in the top surface 14 to transport items downstream from the upstream portion to the downstream portion of the counter. The conveyor means C is shown as an elongate motor driven conveyor belt with upstream and downstream ends, straight, parallel, laterally spaced front and rear sides and defining a flat, horizontal, item supporting top surface 50 which normally moves continuously in a downstream direction relative to the surface 14. The means C is suitably mounted within the counter structure and is related to an opening 51 in the top surface 14 thereof, whereby the top surface 50 is in a common plane with the surface 14. The means C is positioned in the counter with its upstream end portion arranged or projecting between the front side of the produce scale P and the front side of the central portion 15 of the counter, with its front side in close parallel relationship with the front side of the portion 15 and with its downstream end portion extending into and terminating in the downstream end portion 17 of the counter, as clearly illustrated in the drawings.

The means C can be any one of many old and well-known conveyor means commonly employed in check-out counter structures. Since the details of construction of the conveyor means C in no way affect the novelty of this invention and can be any such mechanism well known to those skilled in the art, detailed description thereof need not and will not be undertaken in this disclosure.

An important and significant feature of the means C resides in the fact that its upstream end portion occurs at the surface 14 of the counter in front or forward of the tray 41 of the produce scale P, where it is within convenient reach of the right arm and hand of the checker stationed or positioned relative to the counter, as set forth above.

With the above noted relationship of parts, it will be apparent that the upstream end of the conveyor means is well within the reach of the checker's right arm and hand and that the checker can, in the course of transferring items from a related cart to the counter top, with his left hand, conveniently use his right arm and hand to advance items downstream of the counter, onto the upstream end of the conveyor, as desired or as circumstances require. The conveyor means is arranged so that the checker can, in practice, conveniently move items and produce at the top surface 14 of the counter upstream of the conveyor and on the tray 41 of the produce scale, onto the conveyor by a simple sweeping motion of his right forearm. Accordingly, hand engagement of the produce and items, to gain that end, is not necessary.

The structure and special relationship of parts thus far described embodies the principal novel features of the present invention. Specifically, the structure thus far described provides a checkout counter with a UPI System scanner, a cash register, a produce scale and a conveyor, all of which are arranged and disposed so that a checker stationed or positioned adjacent the counter is afforded unique left arm and hand reach and access to a shopping cart positioned adjacent the counter and convenient right arm and hand access to the cash register, scale and conveyor whereby the checker can easily, conveniently and effectively transfer items, one at a time, from the shopping cart to the counter in proper orientation with the scanner with his left hand and can, coincidentally, conveniently and effectively reach and operate the register, advance items or produce to the scale and advance the items and/or produce onto the conveyor with his right arm and hand, without excessive change of body position or excessive body movement.

In addition to the foregoing, the counter structure A can be and is preferably provided with a customer shelf or desk D above the scale P to facilitate customer handling of money, writing checks and the like. The desk D is an elongate rectangular, flat, horizontal shelf or platform supported by a pair of columns projecting upwardly from the surface 14 adjacent the rear side of the central portion 15 thereof and overlying the rear portion of the produce scale P, as clearly illustrated in the drawings.

The counter A is also preferably provided with a change or coin dispenser E which is operatively related to the cash register R and which operates to automatically dispense customer's change coinage at the end of each sale transaction. The coin dispenser is preferably mounted atop the desk D at the downstream end thereof, as clearly illustrated in the drawings.

In accordance with common practice, the counter A can include other utilitarian features such as bumper rails 60 suitably arranged and positioned about the perimeter of the counter; retaining rails 61 about desired portions of the top surface 14 to prevent lateral displacement and dropping of items therefrom. In accordance with old practice, a bag stand 62 can be provided at the downstream end of the counter to assist the checker or an assistant to suitably bag customers purchases. Additionally, the counter can be provided with utility drawers 63; bag bins 64; and a hinged trap door-like section 65 in the upstream portion of the top surface 14. The trap door-like section 65 is such that it can be dropped down or opened to provide access to a bagging recess 66, as clearly shown in the drawings. The recess 66 can be provided with trash receiving means 67. Suitable control switches S' and S" can be provided in the front side of the counter for putting the UPI System and conveyor C into and out of service.

Figures 2, 4, 5, 6:
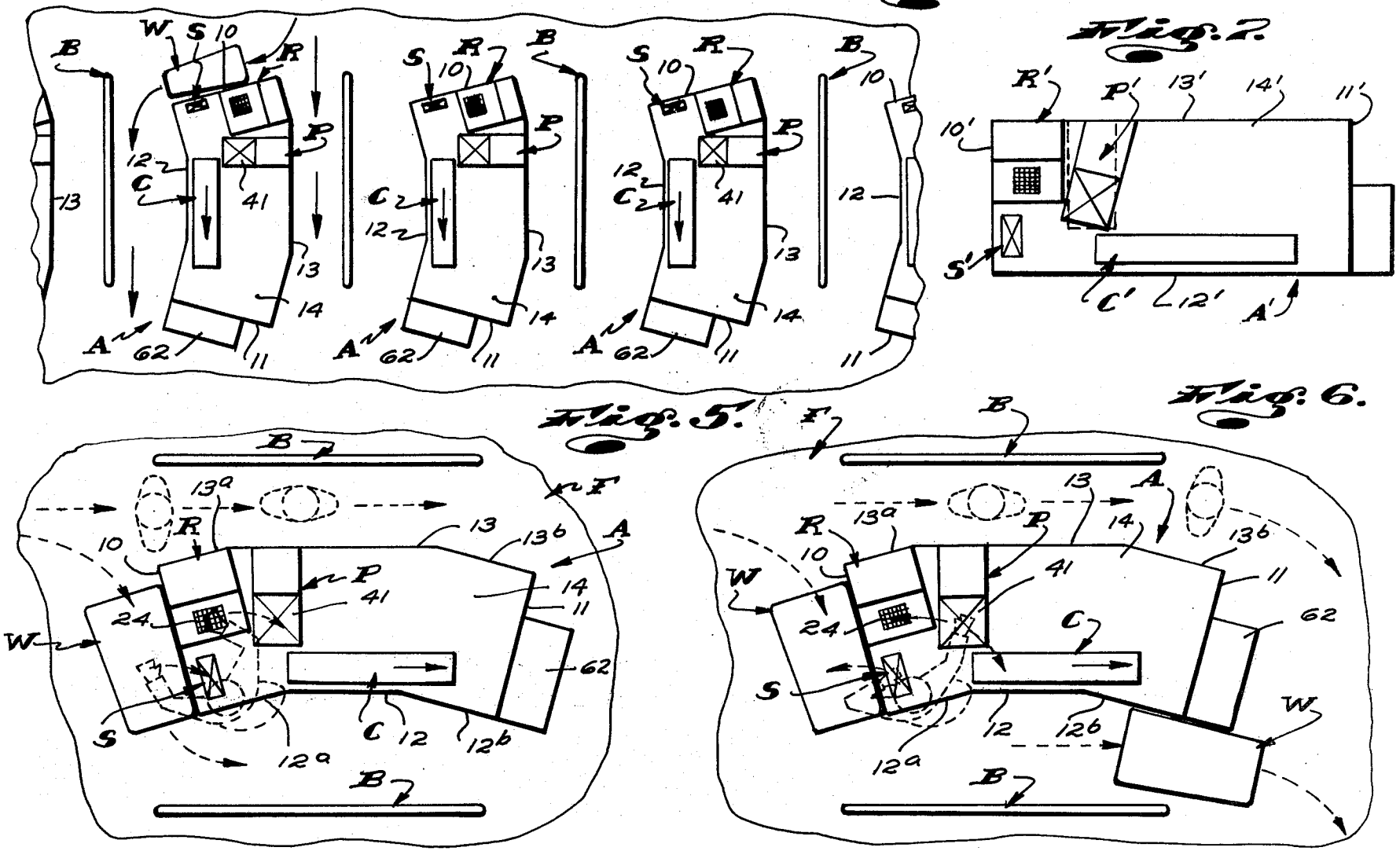
FIG. 4 is a diagrammatic view of a typical installation of a plurality of checkout counter embodying the present invention.
FIGS. 5 and 6 are diagrammatic plan views of the checkout counter here provided.

In furtherance of this invention and as shown in FIGS. 3, 5 and 6 of the drawings, the counter A is arranged in spaced parallel relationship with and between a pair of elongate, parallel, laterally spaced barriers B mounted on and projecting upwardly from the floor F on which the counter is supported or mounted. The barriers B are of limited vertical extent and can be fabricated tube assemblies, partition panel structures or any suitable wall structure, without departing from or affecting the present invention.

The barrier B related to the rear side of the counter A is spaced therefrom and cooperates therewith to define a longitudinally extending customers aisle, with open ends and through which customers can move downstream, from the upstream end to the downstream end of the counter, during the time a checker stationed at the counter handles and checks out the customer's purchases.

The barrier B related to the front side of the counter A is spaced therefrom and cooperates therewith to define a longitudinally extending checker's aisle, with open ends in which the checker stationed at the counter is positioned and through which shopping carts can be conveniently moved downstream, from the upstream end to the downstream end of the counter, after it has been emptied of items, to the downstream end of the counter preparatory to its receiving the items, in bagged condition, for delivery to the customer.

The rear side 13 is spaced from its related barrier B approximately two feet whereby the central portion of the customers aisle is about two feet wide.

The forwardly and upstream or longitudinally and outwardly inclined rear side $13^a$ of the end portion of the counter and the forwardly and downstream or longitudinally outwardly inclined rear side $13^b$ of the counter diverge relative to the barrier B related thereto as they extend longitudinally outwardly, whereby the open ends of the aisle are enlarged to about two feet eight inches and the end portion of the aisle converge longitudinally inwardly toward the central portion of the aisle. The enlarged and tapered upstream end of the customer aisle allows customers to freely enter the aisle in a comfortable, non-confined manner and then guides them into the more confined central portion of the aisle in a comfortable and acceptable manner, as they advance downstream therethrough. The enlarged or tapered downstream end of the customers aisle provides a natural exit from the aisle and toward which customers naturally advance to gain that freedom of movement necessary or desired to collect their possessions and purchases in the process of departing from the checkout counter.

The front side 12 of the counter is spaced about two feet eight inches from its related barrier whereby the central portion of the checker's aisle is about two feet eight inches wide.

The forwardly and upstream or longitudinally outwardly inclined front side $12^a$ and the forwardly and downstream or longitudinally outwardly inclined front side $12^b$ of the counter converge toward their related barrier B so that their free ends terminate in lateral spaced relationship from their related barriers to establish an entrance and an exit the the checker's aisle, which entrance and exit are about two feet wide and of sufficient lateral extent to freely accommodate shopping carts moved downstream into and out of the checker's aisle.

The front side 12 of the central portion and the front sides $12^a$ and $12^b$ of the end portions 13 and 14 of the counter establish a forwardly opening recess which extends longitudinally of the counter to provide the checker stationed in the aisle with abundant working room or space and ample space for the downstream movement of shopping carts in the aisle.

From the foregoing, it will be apparent that the counter A, with its winged plan configuration, when related to the barriers B, while being most conservative of floor space, makes optimum use of floor space, with respect to the comfort of both customers and checkers.

Further, the winged configuration of the counter, in combination with the barriers related thereto establishes customer and checker aisles which are free or void of any and all corners and projections of a nature which might impede or interfere with the normal movement of customers, checkers and/or shopping cart therethrough.

Finally, the flat, vertical upstream or receiver end 10 of the counter A is angularly related to the longitudinal axis of the counter to extend laterally rearwardly and upstream or longitudinally outwardly toward the upstream end of the customer aisle whereby a customer advancing a shopping cart in a downstream direction toward the upstream end of the customer aisle, can easily and conveniently turn the cart to the right, to a limited extent and into engagement with the upstream end of the counter, before the customer enters the customer aisle, and so that the cart is directed and/or guided laterally forwardly, by said upstream end, toward the upstream end of the checker aisle, with the left side of the cart in close, substantial, parallel relationship with the said upstream end of the counter and so that free access to the interior of the basket portion of the cart is afforded to the checker. The upstream end of the counteris angularly related to and converges forwardly and downstream or longitudinally inwardly toward the open upstream end of the checker aisle and is such that when a cart is positioned adjacent thereto, as noted above, the cart is angularly directed into the open upstream end of the checker's aisle in such a manner that the checker can, with his left hand, easily and conveniently tow and turn the cart into the upstream end of the checker aisle for subsequent downstream movement of the cart in that aisle.

As a result of or due to the above noted angular disposition of the receiver or upstream end of the counter, carts moved into desired working relationship therewith and advanced downstream relative thereto need not be deliberately and forcibly manually turned and maneuvered in an awkward or difficult manner, but rather, are guided by the structure provided so that they tend to naturally assume desired disposition when advanced into engagement with the counter and tend to follow a predetermined and desired course as they are manually advanced longitudinally of the construction.

In the preceding, reference was made to the cash register R being provided with electronic operating means which operate to register prices in response to signals received from a related UPI System computer.

Not all UPI Systems include cash registers within the systems. Instead, some systems only include price display units from which the checkers and customers read prices. Such systems, while providing accurate pricing and current maintenance of the store's inventory, require the checkers to manually ring up or register the price of each item on the cash register at the counter.

When the last mentioned class or type of UPI System is related to the counter A, the register R is a conventional cash register and a UPI visual price display unit U is provided to display the prices of items for the benefit of customers and the checker. In all other respects, the counter A remains the same.

The unit U can vary widely in form, but typically, it is a rectangular box-like unit with front and rear display unknown in which the prices are displayed as by means of light emitting diodes or the like, for convenient view of the customer and the checker. The unit U can, for example, be mounted on top of the register R, in an elevated position and angularly disposed for convenient viewing by both the checker and customers at the desk D, as clearly illustrated in the drawings.

Referring briefly to the form of the invention diagrammatically illustrated in FIG. 7 of the drawings, it is to be noted that the counter A′ distinguishes from the counter A in that it is straight and without the angularly disposed end portions which characterize the counter A. The scanner S′ and register R′ are related to the upstream end of the counter A′ and relative to each other in the same manner as those components and portions of the counter A are related.

The scale P′ is related to the register R′ and surface 14′ in the same manner that the scale P, register R and surface 14 are related and the conveyor C′ is related to the scale P′ and the surface 14′ in much the same way that the conveyor C is related to the scale P and surface 14.

While advantage is to be attained by angularly relating the scale P′ relative to the register R′, as shown in FIG. 7, arranging that scale in parallel side by side relationship with the register R′, as shown in dotted lines in FIG. 7, would not in itself constitute a material departure and would fall within the broader scope and spirit of this invention.

The principal dimensions of the counter A and of various parts and portions of the counter, in accordance with common practice, are established to make most efficient use of available floor space, to properly relate to the shopping carts which are to be used in conjunction therewith and to cooperatively receive the several selected makes and models of machine components incorporated therewith. Accordingly, the dimensions and proportioning of the counter are subject to considerable variations.

In retrospect, it will be appreciated that many of the advantages of the invention flow from the configuration of the counter as viewed from the top. In the preferred embodiment of the invention illustrated in FIGS. 1 through 6 inclusive, the principal axis L—L of the left or upstream portion of the checkstand is inclined counterclockwise relative to the mean axis Z—Z of the checkstand. The left end thus extends or projects longitudinally upstream and forwardly from the central portion and toward the checker aisle. Likewise, the principal axis R—R of the right or downstream portion of the checkstand is inclined clockwise relative to the mean axis Z—Z of the checkstand. This end extends longitudinally downstream and forwardly from the central portion and toward the checker aisle. The end walls 10 and 11 converge forwardly, meeting at a point outside the checker aisle and forwardly of the checker station. The angles of inclination are acute, being about 15°.

Because of the orientation of the end portions 16 and 17, the extreme ends of the checker aisle diverge inwardly, or to put it differently, converge outwardly, of the aisle providing an expanded or widened portion between the ends of the aisle, providing an enlarged checker station where the checker may work conveniently and still leave sufficient space for the cart M to be drawn through the checker aisle from the upstream end thereof to the downstream end thereof while the checker remains at the checker station. Because of the orientation of the end portions 16 and 17, the end portions of the customer aisle diverge outwardly at their ends, or to put it differently, converge inwardly, so as to provide an enlarged space at both ends to facilitate entering and leaving of the customer aisle by the customer.

Even though the orientation of the upstream and downstream end portions are important in the best embodiment of the invention now known, it will be understood that other orientations and arrangements of the upstream, downstream, and central portions may be employed while still obtaining many of the benefits of the invention.

It will, of course, be understood that in some embodiments of the invention, the scale P may be employed for weighing products other than produce and that in some applications of the invention, the scale may be entirely omitted.

Additionally, the computer structure is such that considerable and ample space is provided with the counter to accommodate and house those components of a related UPI System which must be or which are preferably related directly to the counter. Such components, in addition to the circuit unit or box for the scanner means, can include scanner logic units, junction boxes and terminal boards, as well as cooling fans and the like.

It is again noted and it is to be particularly considered that present invention does not reside in any one or any special UPI System or in any specific component of such a system, but rather, resides in a novel counter structure in or with which those common counter related components of a selected UPI System can be incorporated for effective and efficient use of the System.

The scale C can, if desired, be electronic scales such as that Model 1500 Scale produced by Hobart Corporation of Troy, Ohio. In such a case, the scale can be operatively connected with the register R and/or with the display unit U, as desired, or as circumstances require.

It is understood that product scanner means similar in nature to the above noted UPI scanner means, but capable of reading and identifying product by their labels, rather than by a code symbol applied thereto, are being developed and that such scanners and their related systems may be known or identified by other than UPI scanners and/or systems. It will be apparent that the checkout counter here provided is such that a product scanner means, such as referred to above, could be related to it without departing from the spirit of the invention.

In the foregoing specification, the invention has been described with particular reference to its best embodiment employing an optical scanner. It will be understood, however, that some of the features of the invention provide improvements which are useful without the scanner and that in such a case, the checkstand may be used with products that have been hand marked, as with crayon, with visible indicia that represent prices, with or without other pertinent information. In that case, the checkstand is particularly convenient and efficient to use for lifting products out of the carts with the left hand onto the item supporting panel 30 that is at the upstream end of the checkstand and manipulating the products as needed with the right hand and ringing up the prices with either the right hand or left hand, as may be convenient with the particular product.

Only typical preferred forms and embodiments having been described, it is to be understood that the invention is not to be limited to the specific details herein set forth, but includes any modifications and/or variations thereof that may appear to those skilled in the art and which fall within the scope of the following claims.

I claim:

1. A checkout system comprising: an elongate floor-supported counter with substantially flat, straight upstream and downstream ends, front and rear sides and a horizontal top surface, said upstream end and said downstream end being at the left side and right side respectively as viewed by a checker facing the center of the counter from the front side thereof;

cash register support means for supporting a cash register with a manually engageable keyboard atop the rear upstream corner portion of said top surface with said keyboard disposed toward the left end portion of said front side;

product support means including an item supporting panel in the counter with said panel coplanar with said surface adjacent said left end and spaced forward from a cash register supported by said cash register support means; and a conveyor means within the counter and having a normally downstream moving item transporting top portion coplanar with said top surface, the longitudinal axis of said top portion extending in the direction of said axis from an upstream portion of said top surface downstream from said cash register support means to the downstream end portion of the top surface.

2. The checkout system set forth in claim 1 which further includes product scale support means for supporting a product scale with a horizontal product receiving tray at said rear side downstream of the cash register with said tray on a plane substantially coplanar with said surface and projecting forwardly beyond the foremost portion of a cash register supported by said cash register support means and adjacent the upstream end of said conveyor means.

3. The system set forth in claim 1 wherein the upstream end portion of the counter with which the cash register support means and the product supporting panel are related, is angularly inclined in a counterclockwise direction relative to the mean longitudinal axis of the counter whereby said upstream end is located forwardly of said axis.

4. The system set forth in claim 1 wherein the conter has a central portion parallel with the mean longitudinal axis of said counter, said upstream end portion being angularly inclined counterclockwise relative to said mean axis and projecting longitudinally upstream and forwardly, said downstream end portion being angularly inclined clockwise and projecting longitudinally downstream and forwardly, whereby said upstream and downstream ends of the counter are inclined forwardly and longitudinally toward a checker station at said front side, said product supporting panel and cash register support means are at said upstream end portion; and a cash register panel supported by said cash register support means are angularly disposed relative to said mean axis.

5. The system set forth as in claim 1, including product scanning elements supported by said product support means whereby products bearing UPI symbols may be scanned to detect prices thereof.

6. The system set forth in claim 5 wherein the cash register support means is adapted to support a cash register on a plane spaced above the top surface whereby a cash register supported thereby can be shifted forwardly to position a portion thereof above a portion of a scanner means supported by the scanner support means.

7. A checkout system comprising: floor-supported counter with substantially flat, straight upstream and downstream ends, front and rear sides and a horizontal top surface;

cash register support means for supporting a cash register with a manually engageable keyboard atop the rear upstream corner portion of said top surface with said keyboard disposed toward the upstream end portion of said front side;

scanner support means for supporting a product scanner, including an item orienting and supporting panel in the counter with said panel coplanar with said surface adjacent said upstream end and spaced forward from a cash register supported by said cash register support means;

product scale support means for supporting a product scale with a horizontal product receiving tray at said rear side downstream of the cash register with said tray on a plane substantially coplanar with said surface and projecting forwardly beyond the foremost portion of a cash register supported by said cash register support means; and a conveyor means within the counter and having a normally downstream-moving item transporting top portion coplanar with said top surface, said top portion having an upstream end portion spaced between the scale and said front side and a downstream end portion at the downstream end portion of the top surface.

8. The system set forth in claim 7 wherein said upstream end and said downstream end are at the left side and right side respectively as viewed by a checker facing the center of the counter from the front side thereof.

9. The system set forth in claim 7 which further includes elongate barriers in lateral spaced parallel relationship from said front and rear sides and cooperating with the counter to define longitudinally extending checker and customer aisles with open upstream and downstream ends.

10. The system set forth in claim 7 wherein the upstream end portion of the counter with which the cash register support means and the scanner support means are related is angularly inclined longitudinally upstream and forwardly relative to the mean longitudinal axis of the counter whereby said upstream end is inclined longitudinally upstream and forwardly and said upstream end portions of said front and rear sides are inclined longitudinally upstream and forwardly, and a cash register and a scanner panel supported by said cash register support means and scanner support means are angularly related to said mean axis.

11. The system set forth in claim 7 which further includes elongate barriers in lateral spaced parallel relationship from said front and rear sides and cooperating with the counter to define longitudinally extending checker and customer aisles with open upstream and downstream ends; the upstream end portion of the counter with which the cash register support means and the scanner support means are related being angularly inclined longitudinally upstream and forwardly relative to the mean longitudinal axis of the counter, whereby said upstream end is inclined longitudinally upstream and forwardly and said upstream end portions of said front and rear sides are inclined longitudinally upstream and forwardly and a cash register and scanner support means are angularly related to said mean axis, said upstream end portion of said rear side cooperating with the rear-side barrier to define a downstream convergent upstream end portion in said customer aisle, said upstream end portion of said front side cooperating with the front-side barrier to define a downstream divergent upstream end portion in said checker aisle.

12. The system set forth in claim 7 wherein the upstream end portion of the counter with which the cash register support means and the scanner support means are related is angularly inclined longitudinally upstream and forwardly relative to the mean longitudinal axis of the counter, whereby said upstream end is inclined longitudinally upstream and forwardly and a cash register and a scanner panel supported by said cash register and scanner support means are angularly related to said mean axis, said scale support means having a rear portion downstream of said upstream end portion and a front portion extending to said upstream end portion of the counter whereby the forward upstream portion of a scale tray supported by said scale support means projects to said upstream end portion of the counter substantially forward of a cash register supported by the cash register support means.

13. The system set forth in claim 7 wherein the counter has a central portion parallel with the mean longitudinal axis of said counter and upstream and downstream end portions angularly related to said mean axis and projecting longitudinally upstream and forwardly and longitudinally downstream and forwardly, respectively, whereby said upstream and downstream ends of the counter are inclined forwardly and longitudinally toward the central portion, and the upstream and downstream end portions of said front and rear sides respectively are inclined forwardly and longitudinally outwardly relative to the said central portion; said scanner and cash register support means being at said upstream end portion; and a cash register and a scanner panel supported by those support means being angularly disposed relative to said mean axis.

14. The system set forth in claim 13 which further includes elongate barriers in lateral spaced parallel relationship from said front and rear sides and cooperating with the counter to define longitudinally extending checker and customer aisles with open upstream and downstream end portions, said upstream end portion of said rear side cooperating with the rear-side barrier to form a downstream convergent portion of said customer aisle at the upstream end of said customer aisle, said downstream end portion of said rear side cooperating with the rear-side barrier to form a downstream divergent portion of said customer aisle at the downstream end of said customer aisle, said upstream end portion of said front side cooperating with the front-side barrier to form a downstream divergent portion of said checker aisle at the upstream end of said checker aisle, said downstream end portion of said front side cooperating with the front-side barrier to form a downstream convergent portion of said checker aisle at the downstream end of said checker aisle.

15. The system set forth in claim 13 wherein the upstream end portion of the counter with which the cash register support means and the scanner support means are related in angularly inclined longitudinally upstream and forwardly whereby said upstream end is inclined longitudinally upstream and forwardly, and said upstream end portions of said front and rear sides are inclined longitudinally upstream and forwardly, relative to said mean axis of the counter and a cash register and a scanner panel supported by said cash register support means and scanner support means are angularly related to said mean axis, said scale support means having a rear portion downstream of said upstream end portion and a front portion substantially intersecting said upstream end portion of the counter whereby the forward upstream portion of a scale tray supported by said scale support means project to said upstream end portion of the counter and substantially forward of a cash register supported by the cash register support means.

16. The system set forth in claim 14 wherein the upstream end portion of the counter with which the cash register support means and the scanner support means are related is angularly inclined longitudinally upstream and forwardly relative to the mean longitudinal axis of the counter whereby said upstream end is inclined longitudinally upstream and forwardly, and said upstream end portions of said front and rear sides are inclined longitudinally upstream and forwardly, and a cash register and a cash register and a scanner support means are angularly related to said mean axis, said scale support means is in said central portion adjacent said upstream end portion and projects forwardly from adjacent the rear side of the central portion to converge with said upstream end portion of the counter whereby the forward upstream portion of the tray of a scale supported by said scale support means projects to said upstream end portion of the counter in substantial forward spaced relationship with a cash register supported by the cash register support means.

17. The system set forth in claim 7 wherein the cash register support means is adapted to support a cash register on a plane spaced above the top surface whereby a cash register supported thereby can be shifted forwardly to position a portion thereof above a portion of a scanner means supported by the scanner support means.

18. A checkout system comprising: floor-supported counter having an elongate central portion with vertical front and rear sides and a horizontal top;

an upstream, left end portion with vertical front and rear sides;

a vertical upstream, left end and a horizontal top;

a downstream, right end portion with vertical front and rear sides;

a vertical downstream, right end and a horizontal top;

said front and rear sides of the central left end and right end portions are joined and the tops of said central, left end and right end portions are joined;

a cash register of substantial rectilinear plan configuration with a front side with a laterally and upwardly disposed manual keyboard, said cash register positioned on the top of the left end portion of the counter with its front side disposed substantially forwardly toward and in spaced relationship from the front side of the left end portion of the counter and with two other adjacent sides substantially adjacent the left end and rear side of said left end portion of the counter;

a product scale having a substantially flat product supporting tray and positioned in the top of said central portion of the counter adjacent to and downstream of the cash register with said tray substantially coplanar with the top and with a forward portion projecting forwardly in the top beyond the front side of the cash register;

an elongate conveyor belt with upstream and downstream ends and a downwardly moving top portion said conveyor belt mounted in the counter with its upstream end between said tray and front side of the central portion of the counter, its downstream end in the right end portion of the counter and with its top portion substantially coplanar with the top of the counter;

a shopping cart parking station on the floor adjacent the left end of the counter to facilitate positioning;

an upwardly opening item carrying shopping cart adjacent the left end of the counter;

a checker's station on the floor adjacent the front side of the left end portion of the counter and from which the top of the left end portion of the counter forward of the cash register and the interior of a shopping cart adjacent said left end of the counter are in left arm's reach and the cash register keyboard, tray and conveyor are in right arm's reach of a checker at said checker's station and disposed substantially rearwardly.

19. The system set forth in claim 18 which further includes a product scanner means in the right end portion of the counter, said scanner means having an item-supporting panel in the top of the right end portion of the panel between the front side thereof and the front side of the cash register.

20. The system set forth in claim 18 wherein the right end portion of the counter is inclined forwardly and to the left relative to the central portion of the counter, whereby the axes on which the cash register and the scale project forwardly converge forwardly; the left end of the counter is inclined rearwardly and to the left and the front and rear sides of the left end portion of the counter extend rearwardly and to the right to converge with the front and rear sides of the central portion of the counter.

21. The system set forth in claim 20 which further includes a product scanner means in the right end portion of the counter, said scanner means having an item-supporting panel in the top of the right end portion of the panel between the front side thereof and the front side of the cash register.

22. The system set forth in claim 18 wherein the right end portion of the counter is inclined forwardly and to the left relative to the central portion of the counter, whereby the axes on which the cash register and the scale project forwardly converge forwardly; the left end of the counter is inclined rearwardly and to the left and the front and rear sides of the left end portion of the counter extend rearwardly and to the right to converge with the front and rear sides of the central portion of the counter; the right end portion of the counter is inclined forwardly and to the right relative to the central portion of the counter whereby the right end of the counter is inclined rearwardly and to the right and the front and rear sides of the right end portion of the counter extend rearwardly and to the left to converge with the front and rear sides of the central portion of the counter.

23. The system set forth in claim 22 which further includes a product scanner means in the right end portion of the counter, said scanner means having an item-supporting panel in the top of the right end portion of the panel between the front side thereof and the front side of the cash register.

24. The system set forth in claim 4 which further includes elongate barriers in lateral spaced parallel relationship from said front and rear sides and cooperating with the counter to define longitudinally extending checker and customer aisles with open upstream and downstream ends, said upstream end portion of said rear side cooperating with the rear-side barrier to form a downstream convergent portion of said customer aisle at the upstream end of said customer aisle, said downstream end portion of said rear side cooperating with the rear-side barrier to form a downstream divergent portion of said customer aisle at the downstream end of said customer aisle, said upstream end portion of said front side cooperating with the front-side barrier to form a downstream divergent portion of said checker aisle at the upstream end of said checker aisle, and said downstream end portion of said front side cooperating with the front-side barrier to form a downstream convergent portion of said checker aisle at the downstream end of said checker aisle.

* * * * *